United States Patent [19]

Rankin

[11] 4,278,127

[45] Jul. 14, 1981

[54] APPARATUS FOR RETRIEVING DRILL COLLARS

[76] Inventor: E. Edward Rankin, Wellheads Ind. Centre Unit D-14, Aberdeen (Dyce), Scotland, AB2 OEZ

[21] Appl. No.: 14,899

[22] Filed: Feb. 23, 1979

[51] Int. Cl.[3] ..... F42B 3/00; E21B 29/00

[52] U.S. Cl. ..... 166/63; 166/242; 166/297; 102/313; 285/4

[58] Field of Search ..... 166/63, 55, 55.1, 297, 166/242; 285/3, 4; 29/421 E; 83/54, 184, 178; 102/20, 21, 24 HC

[56] References Cited

U.S. PATENT DOCUMENTS

| | | | |
|---|---|---|---|
| 1,783,605 | 12/1930 | Della | 285/4 |
| 1,814,800 | 7/1931 | Heeter | 166/242 |
| 2,673,614 | 3/1954 | Miller | 166/242 |
| 3,053,182 | 9/1962 | Christopher | 102/24 HC |
| 3,105,548 | 10/1963 | Ownby | 166/63 |
| 3,233,688 | 2/1966 | Bell | 102/24 HC |
| 3,417,822 | 12/1968 | Howell | 166/242 |
| 3,712,378 | 1/1973 | Oliver | 166/63 |
| 3,869,150 | 3/1975 | Brown | 166/242 |
| 4,042,019 | 8/1977 | Henning | 166/63 |
| 4,184,430 | 1/1980 | Mock | 166/297 |

*Primary Examiner*—James A. Leppink

*Attorney, Agent, or Firm*—Felsman & Bradley

[57] ABSTRACT

An apparatus for retrieving drill collars in an earth boring drill string when stuck. A sub is connected between two drill collars at various points. Each sub is a cylindrical member with a reduced annular or notched area at one point that is no greater in wall thickness than the drill pipe. A locator is secured to a wire line and lowered into the drill string to the vicinity of one of the subs located above the stuck point. The locator carries an explosive charge of capacity sufficient to cut drill pipe. The locator has a pivotal dog that engages a landing in the sub. The landing is spaced above the annular area a distance selected to position the explosive charge adjacent the annular area when the dog engages the landing.

3 Claims, 4 Drawing Figures

APPARATUS FOR RETRIEVING DRILL COLLARS

BACKGROUND OF THE INVENTION

1. Field of the Invention:

This invention relates in general to earth boring operations and in particular to an apparatus used to part the drill string in the drill collars to retrieve part of the drill collars should the drill string be stuck.

2. Description of the Prior Art:

In earth boring operations for oil and gas, a rotating drill string with a three cone drill bit is commonly used. The drill string is made up of drill pipe and drill collars. The bit usually is connected to a number of drill collars, typically 10 to 30 or more. The drill pipe is connected above the drill collars. Both the drill pipe and drill collars are hollow steel cylindrical members in sections of 30 feet or so. Fluid, normally a liquid, is pumped down the internal bore of the drill pipe and drill collars, out the drill bit, and back up the annular space between the drill string and the borehole wall. This circulates cuttings to the surface and cools the bit. The drill collars are much thicker than the drill pipe sections and are used to stabilize the bit and apply weight. Although thicknesses vary, typical drill pipe might have a wall thickness of $\frac{1}{4}$ to $\frac{1}{2}$ inch while the drill collars might have a wall thickness of $1\frac{7}{8}$ inch.

It is not uncommon for drill pipe to become stuck, usually due to a cave-in above the bit. In serious cases, the drill string cannot be rotated, pulled up, nor can circulation through the bit be established. Various techniques are known to free stuck pipe. In one technique, a free-point indicator can be lowered into the drill string on wire line. Tension is placed on the string while the free-point indicator is positioned at various points. It detects slight stretching of the pipe, which will not occur below the stuck point. Eventually this stuck point may be located.

Then, an explosive charge can be lowered on wire line and positioned near one of the drill pipe joints above the stuck point. The explosive is initiated while left-hand torque is applied to the string. The explosive impact in this "backoff" operation hopefully causes the joint to unscrew at that point. Then hydraulic jars, chemicals and other devices can be used to try to loosen the string or "fish" remaining in the hole.

At times "backoff" operations fail, and a cutter explosive charge is lowered on wire line to cut the drill pipe above the stuck point to salvage as much pipe as possible. The cutter charge is a radially directed shaped charge having sufficient energy to sever the drill pipe. All of the drill collars and the remaining drill pipe below where cut will be abandoned in the hole. A new hole may be started, or the old hole may be directionally drilled from a new angle from above the abandoned drill pipe.

If the stuck point is at the bit or in the collars, at present there is no known way to salvage the drill collars if a "backoff" operation fails. Cutter charges may be sufficient to cut the drill pipe, but no known charges have sufficient energy to part a drill collar. Consequently all of the expensive drill collars will ordinarily be lost since the operator will be forced to cut the drill pipe, even though the stuck point may be far below.

SUMMARY OF THE INVENTION

It is accordingly the general object of this invention to provide an improved apparatus for retrieving drill collars in a stuck drill string.

It is a further object to provide a sub for connection in the string of drill collars that has the ability to withstand the normal torque applied, and further has a portion that can be parted by a conventional explosive charge.

It is a further object to provide a sub for connection in the drill collar string that has an area that can be parted by conventional explosive charge, and a locator that precisely locates the charge adjacent the area.

In accordance with these objects, an apparatus is provided that includes one or more subs adapted to be connected into the string of drill collars at various points. Each sub is comprised of two members screwed together. The upper member has an internal thread between its ends, and an internal landing of reduced diameter above the threads. The lower member has threads on its upper end, a channel or groove on its outer surface below the threads, and an external shoulder below the channel. The channel is substantially no greater than the wall thickness of drill pipe, allowing it to be parted by a drill pipe cutter charge. The lower end of the upper member bears against the shoulder to transmit torque. A slot and key connecting the outer surfaces of the upper and lower members further strengthen the assembly.

The explosive charge is lowered on wire line with a locator that precisely positions the charge adjacent the channel. The locator has a pivotally mounted dog that engages the landing to prevent further downward movement, and precisely locates the charge. Retention and release means in the locator retain the dog in a closed position until in the vicinity of the sub. For fluid circulation, if desired, a port is located in the upper member adjacent the channel. In that case, the channel can be pierced by a conventional perforating shaped charge.

DESCRIPTION OF THE PREFERRED EMBODIMENT

Figure 1:
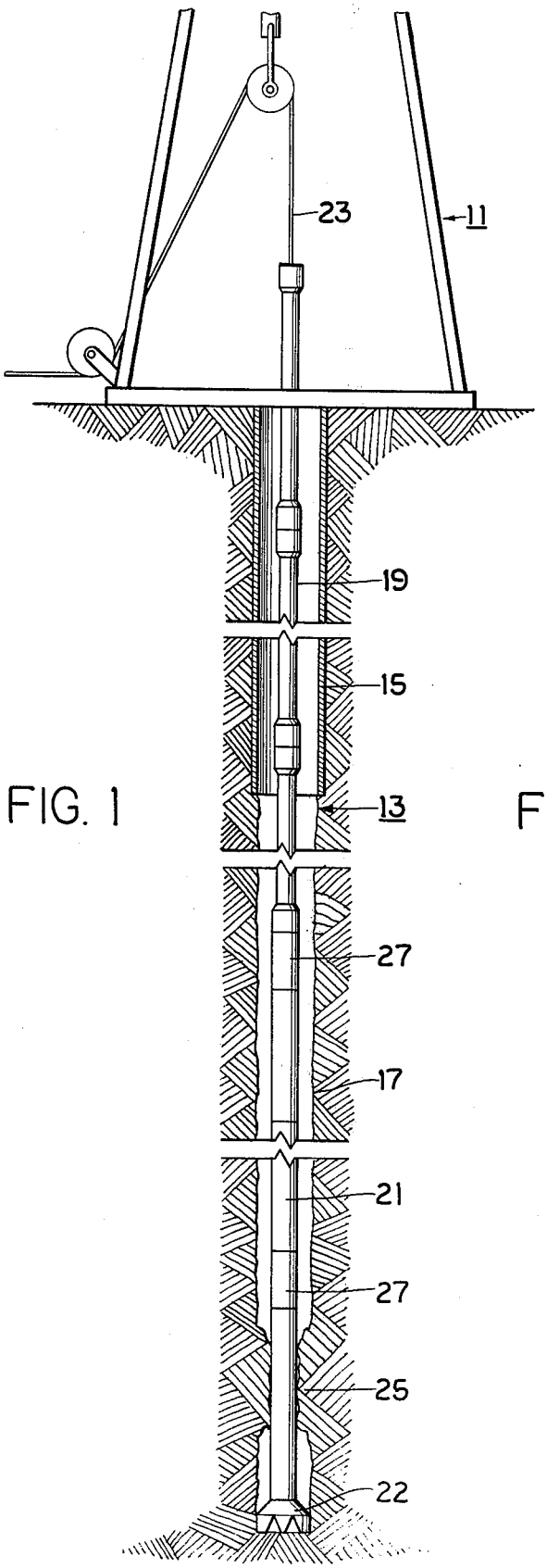
FIG. 1 is a schematic view of an earth boring string of drill pipe, having two subs in accordance with this invention connected into the string.

Referring to FIG. 1, a drill rig 11 is schematically shown with a drill string positioned in the hole or well bore 13. Hole 13 includes a cased section 15, where steel pipe or casing has been previously cemented, and an open hole section 17. The drill string includes a number of sections of drill pipe 19, to which a number of sections of drill collars 21 are connected. A drill bit 22 having three rotatable conical cutters is connected to the bottom of the drill collars 21. The sections of drill pipe 19 and drill collars 21 are connected together by threaded connections. A wire line 23 is shown lowered into the drill string. A caved-in section or stuck point is indicated by numeral 25.

Figure 2:
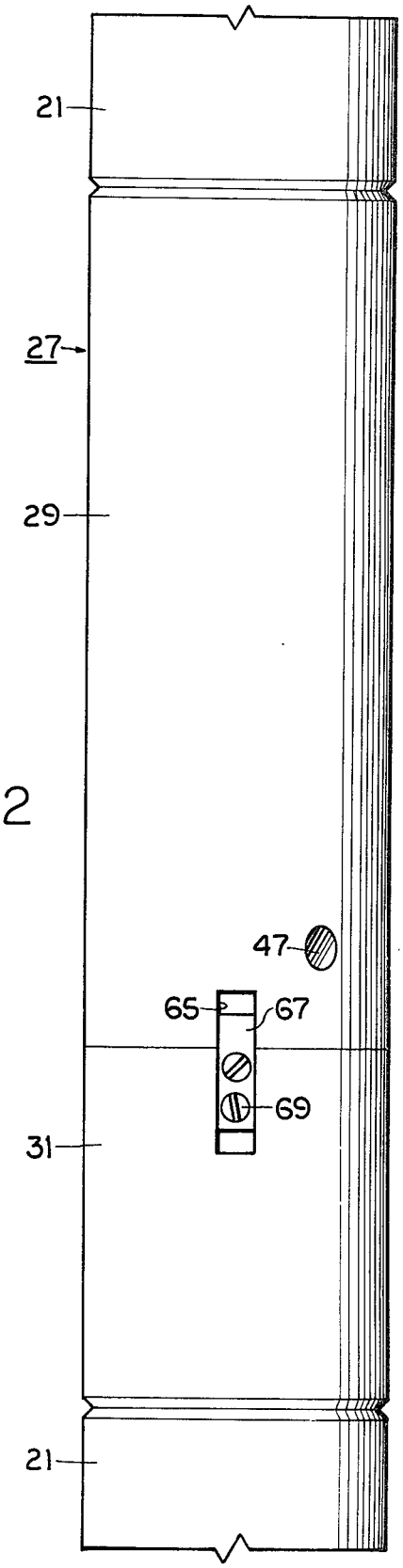
FIG. 2 is a side elevational view of one of the subs of FIG. 1.
Figure 3:
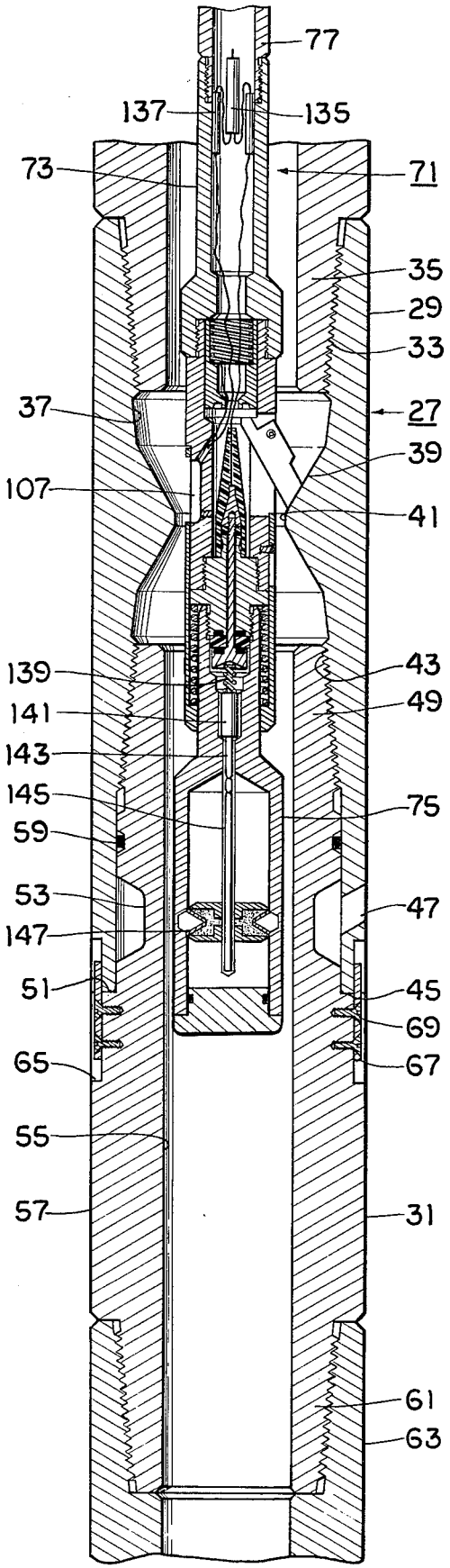
FIG. 3 is a vertical sectional view of one of the subs of FIG. 1, with the wire line apparatus in accordance with this invention also shown in vertical section, the locator portion being shown in the open position.

Two subs 27 are shown connected into the string for serving as release means for allowing the drill string above the sub to be removed should the string become stuck. Referring to FIGS. 2 and 3, each sub 27 comprises a short assembly, about 2½ feet long and of outer diameter equal to that of the drill collar 21. Each sub has a cylindrical upper member 29 and a cylindrical lower member 31.

Upper or female member 29 has internal threads 33 for connection to the lower end or male pin 35 of a drill collar 31. Upper sub 29 has an internal bore 37 that has an annular landing 39 of reduced diameter. Landing 39 has tapered upper and lower shoulders that converge to a crest 41 of small width and minimum diameter. The diameter of crest 41, however, is no less than the inner diameter of the drill pipe 19 and drill collars 21. A set of internal threads 43 are formed in the internal bore 37 above landing 39. The length of threads 43 is approximately the same as internal threads 43. The lower end of threads 33 is spaced above the lower end 45 of the upper member 25. Lower end 45 is a smooth lip or edge lying in a plane perpendicular to the longitudinal axis of sub 27. The internal bore 37 from the lower end 45 to the base or lower end of internal threads 43 is smooth and cylindrical, defining a sleeve. A round port 47 is located near the lower end 45. It extends through the wall of the upper member 29 and is oriented slightly upward from inside to outside.

The lower or male member 31 is approximately the same length as the upper member 29. Lower member 31 has a set of external threads or a male pin 49 on its upper end that engages the internal threads 43 of the upper member 29. An upwardly facing external shoulder 51 is formed in the outer surface of the lower member 31 a selected distance below the base or lower edge of the external threads 49, defining a mating surface above shoulder 51 that is closely received in the bore 37. A groove or channel 53 is formed in the outer surface of the lower member 31 between the shoulder 51 and threads 49. Channel 53 is a generally rectangular annular band having tapered sides. Lower member 31 has a smooth cylindrical internal bore 55 extending through it. The wall thickness in the non-overlapping portion 57 of the lower member 31 is substantially the same as the wall thickness of the drill collars 21. The non-overlapping portion 57 is the part where the lower member does not overlap with a drill collar 21 or with the upper member 29. The wall thickness between the internal bore 55 and channel 53 is substantially no greater than the wall thickness of the thickest conventional drill pipe 19. Stated another way, it is no thicker than what a radial drill pipe cutter charge of maximum size for the drill string is able to cut. An o ring 59 is located in a groove on the outer surface of the lower member 31 for sealing against the internal bore 37 of the upper member 29. The lower member 31 has external threads, or a male threaded pin 61, on its lower end for connection to the female or internal threads 63 of a drill collar 21.

When fully made up or screwed together to a torque in excess of that expected to be exerted under normal drilling conditions, the lower end 45 of upper member 21 will be bearing against the shoulder 51. At this time, as shown in FIG. 2, a number of slots 65 are cut in the outer surface of the upper and lower members 29, 31 perpendicular to the longitudinal axis of sub 27. Slot 65 cuts across the lower end of the upper member 29 and across the upper end of the lower member 31. These slots are in alignment, and rectangular plates or keys 27 are inserted in the slots 65 and fastened by screws 69. Keys 67 and slots 65 serve as torque transmitting means to transmit torque from the upper member 29 to the lower member 31.

In the preferred embodiment, for 6½ inch outer diameter drill collars 21, the wall thickness in the non-overlapping portion 57 is the same as the drill collars, approximately 1⅞inches thick. The wall thickness at channel 53 is 9/16 inch and channel 53 is approximately 1 inch wide at its base. The wall thickness for drill pipe varies depending upon the grade, but is in the range from ¼ inch to ½ inch.

Figure 4:
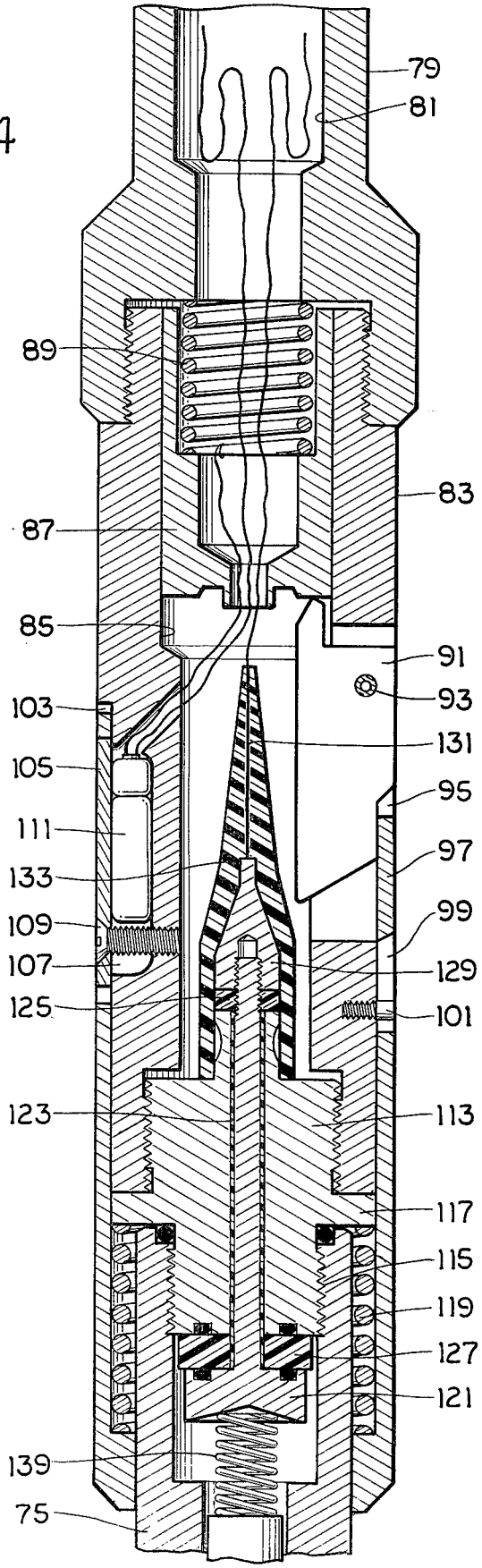
FIG. 4 is an enlarged view of the locator for the wire line apparatus of FIG. 3, shown in the closed position.

The wire line assembly 71, as shown in FIGS. 3 and 4, includes a locator assembly 73 to which a conventional cutter carrier 75 is secured at the bottom. A conventional casing collar locator and weight assembly 77 is located above the locator 73. Referring to FIG. 4, the locator assembly 73 has an upper housing 79 for connection to the casing collar locator and weight assembly 77. Upper housing 79 has an internal bore 81 and is connected to a lower housing 83. Lower housing 83 has an internal bore 85 in which a piston 87 is slidably carried. A coil spring 89 is compressed between piston 87 and upper housing 79 to bias or urge the piston 87 downward.

Three dogs 91 (only one shown), are pivotally mounted to lower housing 83 by roll pins 93. The dogs 91 are spaced apart 120° and are thin rectangular members. The lower housing 83 has a slot 95 for each dog 91, that allows the dogs to protrude outward. Each dog 91 has an upper end that contacts piston 87. Roll pins 91 are positioned so that if piston 87 were allowed to move downward, the dogs 91 would move from the closed position as shown in FIG. 4 to the open position as shown in FIG. 3.

A sliding cylindrical sleeve 97 prevents the dogs 91 from moving to the open position. The upper end of sleeve 97 covers the lower ends of dogs 91, as shown in FIG. 4, until the sleeve 97 is moved downward, as shown in FIG. 3. Sleeve 97 has a slot 99 on one side containing a screw or stop 101 to prevent further downward movement. Sleeve 97 has another slot 103 containing a close fitting rectangular plate 105 that covers a recess 107 formed in the lower housing 83. Plate 105 is secured in place by a screw 109. A light explosive detonator or squib 111 is secured in recess 107.

A sub 113 is connected to the bottom of lower housing 83. Sub 113 has lower external threads 115 and a flange 117 extending outwardly from the threads to the sleeve 97. A coil spring 119 is compressed between the lower end of flange 117 and the bottom of sleeve 97, biasing or urging the sleeve 97 downward. Sub 113 has a small axial bore containing a contact rod 121 that is electrically insulated from sub 113 by insulating sleeve 123 and upper and lower washers 125 and 127. A metal nut 129 is connected to the top of contact rod 21. An electric wire 131 extends to the nut 129, and an insulating boot 133 covers the nut.

Referring to FIG. 3, a double diode 135 is mounted in upper housing 79 to assure that the voltage of one polarity will be supplied to contact rod 121 and the opposite polarity to detonator 111. Diode 135 is connected to the detonator 111, and to wire 131 by a boot 137.

Cutter assembly 75 is connected to threads 115 of sub 113. A coil spring 139 is located in the cutter assembly 75 and bears against the lower end of contact rod 121 to provide electrical connection to a second detonator 141. This detonator, in turn, is located adjacent a third detonator 143, which in turn is crimped to blasting or prima cord 145. An annular shaped tubing cutter charge 147 is located near the bottom of the cutter assembly 75. Prima cord 145 passes through the center of the charge 147. Charge 147 directs the explosive force radially outward, and is of a conventional type for cutting tubing and drill pipe. Preferably, for the sub shown, it has a $2\frac{5}{8}$ inch outer diameter. Cutters of this size, with the ability to cut through a 9/16 inch wall thickness steel pipe, are known.

In operation, subs 27 will be assembled at the factory and normally not taken apart in the field. Preferably, several subs 27 will be placed in the drill string, one directly above the bit, and others further upward in the string of drill collars. Should the drill string become stuck in the drill collars, as shown by numeral 25 in FIG. 1, and should all other efforts to retrieve the entire string fail, then one of the subs 27 will be parted.

If the location of the stuck point is not known, a free-point indicator (not shown) may be lowered on wire line 23 and positioned at various points in the drill string. While thefree-point indicator is stationary, tension is applied to the drill string by rig 11. If movement or stretching is detected, normally the stuck point will be below where the measurement is being taken. If no movement is detected, then the stuck point should be above where the measurement is taken. By taking several measurements, the stuck point should be located. The closest sub 27 above the stuck point will then be parted. If the stuck point cannot be located then the lowest sub should be shot first. If the drill string is not free after parting, then each succeeding sub upward should be shot, until parting is achieved.

To part a sub 27, wire line assembly 71 is lowered into the drill string with the dogs 91 in the closed position until assembly 71 reaches the approximate depth of the selected sub 27. The casing collar locator will indicate this in a concurrent surface indication on the instruments at the surface. The wire line assembly is pulled about two feet or so above the sub 27. Current of the proper polarity is supplied from the surface instruments through insulated cable 23 to detonator 111. It explodes, severing screw 109 and blowing plate 105 off. Plate 105 previously retained sleeve 97 in its upper position, and once gone, coil spring 119 expands, pushing the sleeve 97 downward until stop 101 bumps against the top of slot 99. Once in the lower position, as shown in FIG. 3, sleeve 97 is free of engagement with dogs 91. Consequently, piston 87 moves downward, pivoting the lower ends of dogs 91 outward, it being urged downward by coil spring 89. The spring biased piston 87, spring biased sleeve 97, plate 105 and detonator 143 serve as retention and release means for maintaining the dogs in a closed position while lowering the locator and charge into the drill string and for selectively moving the dogs to an open position to engage the landing to prevent movement in one direction so as to position the charge adjacent the annular area.

After the dogs 91 are opened, the wire line assembly 71 is lowered until the dogs 91 contact the landing 39. At this point, wire line 23 will become slack, and radial charge 147 will be precisely located adjacent channel 53. Then, current of the opposite polarity is supplied, it proceeding through diode 135 to detonator 141. Detonator 141 initiates detonator 143, which in turn fires prima cord 145 and intitiates the charge 147. Charge 147 will cut through channel 53. The wire line assembly 71 is then removed with the dogs 91 remaining open. The drill string is pulled out, leaving the lower member 31 and the remaining portions of the drill string below it. If for some reason, channel 53 is not completely severed, tension to the drill string can be applied to separate the weakened area.

Before parting the string, it may be desired to only perforate the sub to attempt to restore circulation to free the drill string. If so, the same procedure above is used except aconventional perforating shaped charge is used instead of the radial explosive. This type of shaped charge directs the explosive in a small conical pattern in one direction outward, thus providing a small hole. Circulation through the hole and port 47 may then be attempted. Although circulation through bit 22 may be impossible, it is possible that circulation can be achieved through one of the subs located above the bit 22.

It should be apparent than an invention having significant improvements has been provided. The sub provides an annular band of wall thickness substantially no greater than drill pipe wall thickness so that it can be parted. The overlapping upper and lower members, with their slots and keys, however, provide adequate tension and torque withstanding properties, so that the sub will not accidentally part under drilling conditions. The wire line assembly and landing in the sub precisely locate the charge to avoid firing in the wrong area.

While the invention has been shown in only one of its forms, it should be apparent to those skilled in the art that it is not so limited but is susceptible to various changes and modifications without departing from the spirit thereof.

I claim:

1. In combination with an earth boring drill string having drill pipe secured above a number of drill collars, the drill collars having a greater wall thickness than the drill pipe, a sub adapted to be secured between sections of drill collars, comprising:

a cylindrical first member adapted to have a first end secured to one of the drill collars and having a set of internal threads located between the first end and a second end; and a cylindrical second member having a set of external threads on a first end adapted to engage the internal threads of the first member, and a second end adapted to be secured to another drill collar, the second member having an external annular shoulder spaced from the external threads that contacts the second end of the first member when fully made up;

the second member having an annular band located between the external shoulder and the external threads that is of wall thickness sufficiently thin for enabling a radial explosive charge capable of parting drill pipe to be lowered on a wire line adjacent the annular band and initiated to part the drill string at the annular band, allowing the drill collars located above the parted sub to be retrieved; and a port formed in the first member adjacent the annular band for fluid circulation should perforation of the annular band be desired.

2. In combination with an earth boring string having drill pipe secured above a number of drill collars, the drill collars having a greater wall thickness than the wall thickness of the drill pipe, a sub adapted to be secured between sections of drill collars, comprising:

a cylindrical upper member adapted to be secured to the lower end of one of the drill collars, the upper member having an internal bore with annular landing of diameter less than immediately adjacent it, the upper member also having a set of internal threads located below the landing and above its lower end;

a cylindrical lower member adapted to be secured to the upper end of one of the drill collars, the lower member having a set of external threads on its upper end for engaging the internal threads of the upper member, the lower member having an external upwardly facing shoulder spaced below the base of the external threads, the lower member having an annular channel formed on its outer surface between the base of the external threads and the shoulder, the lower end of the upper member being in contact with the shoulder and covering the channel when the members are fully made up;

the upper member having a slot formed in its outer surface at its lower end, the lower member having a slot formed in its outer surface at the shoulder, the slot of the upper member mating with the slot of the lower member when the members are fully made up;

a key secured in the slots to lock the members to each other;

the channel wall thickness being sufficiently thin to be parted by a radially explosive charge; and a port formed in the upper member adjacent the channel for fluid circulation should perforation of the channel be desired, rather than parting.

3. A method of retrieving drill collars located in an earth boring drill string above a stuck point, the drill collars being tubular members having greater wall thickness than the wall thickness of the drill pipe, the method comprising:

providing a hollow sub with an annular band of reduced wall thickness capable of being parted by a radial explosive lowered on wireline;

mounting the sub between two of the drill collars as the drill collars are being lowered into the well;

after the drill string has become stuck, lowering on wireline the radial explosive through the drill collars and into the sub adjacent the annular band; and firing the radial explosive and applying tension to the drill string to part the sub at the annular band, retrieving the drill collars located above the sub.

* * * * *